US006026531A

United States Patent [19]

Pruitt

[11] Patent Number: 6,026,531

[45] Date of Patent: Feb. 22, 2000

[54] TORSO MASSAGING AND SCRUBBING DEVICE

[76] Inventor: Lloyd Pruitt, 8074 Lauder, Detroit, Mich. 48228

[21] Appl. No.: 09/054,560

[22] Filed: Apr. 3, 1998

[51] Int. Cl.[7] ..... A47K 7/02

[52] U.S. Cl. ..... 15/160; 15/222; 15/244.1; 601/124; 601/132

[58] Field of Search ..... 15/110, 160, 222, 15/229.13, 210.1, 244.1; 24/211, 214; 601/124, 132

[56] References Cited

U.S. PATENT DOCUMENTS

| | | | |
|---|---|---|---|
| 863,144 | 8/1907 | Bowser | 601/123 |
| 1,699,261 | 1/1929 | Wissmar | 15/222 |
| 2,014,293 | 9/1935 | Riley | 15/222 |
| 2,505,610 | 4/1950 | Ellinger | 15/160 |
| 2,615,189 | 10/1952 | Novick | 15/160 |
| 2,631,319 | 3/1953 | Gotsfeld | 15/160 |
| 2,691,787 | 10/1954 | Rosenwein | 15/222 |
| 3,085,276 | 4/1963 | Swanson, Jr. | 15/244.1 |
| 3,915,159 | 10/1975 | Simjian | 601/132 |
| 4,187,575 | 2/1980 | Collins | 15/222 |
| 4,422,205 | 12/1983 | Braxter, Sr. | 15/210.1 |
| 4,512,054 | 4/1985 | Clark | 15/222 |
| 4,699,127 | 10/1987 | Schley | 128/62 |
| 4,718,409 | 1/1988 | Gershov et al. | 15/222 |
| 5,035,523 | 7/1991 | Allinder | 15/222 |
| 5,386,609 | 2/1995 | Xenos | 15/222 |
| 5,528,792 | 6/1996 | Nazemi | 15/160 |
| 5,537,709 | 7/1996 | Taragos | 15/222 |
| 5,676,638 | 10/1997 | Shefi | 601/124 |

*Primary Examiner*—Mark Spisich
*Assistant Examiner*—Theresa T. Snider
*Attorney, Agent, or Firm*—Rader, Fishman & Grauer PLLC

[57] ABSTRACT

A massaging and scrubbing device comprising two elongated arms and a torso contacting device. The arms are fabricated from a water impervious material in a preformed configuration. The arms have a resiliency thereto that permits them to be flexed slightly during use and to return to their original shape when not in use. The arms releasably support the torso contacting device in a substantially immovable position when the device is in use. Therefore, the torso contacting device can be removed and cleaned or replaced as needed.

9 Claims, 1 Drawing Sheet

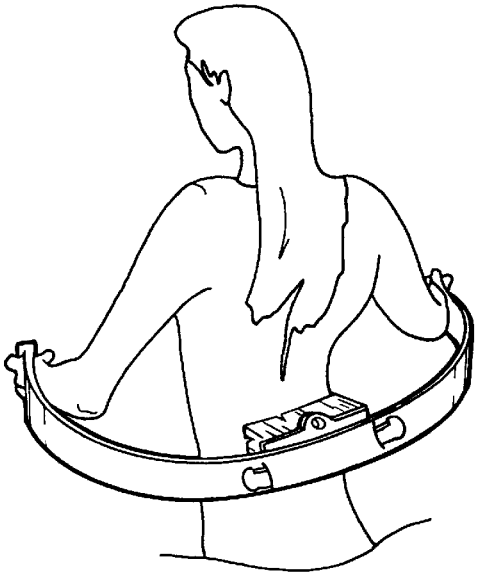
Fig-1
Fig-2
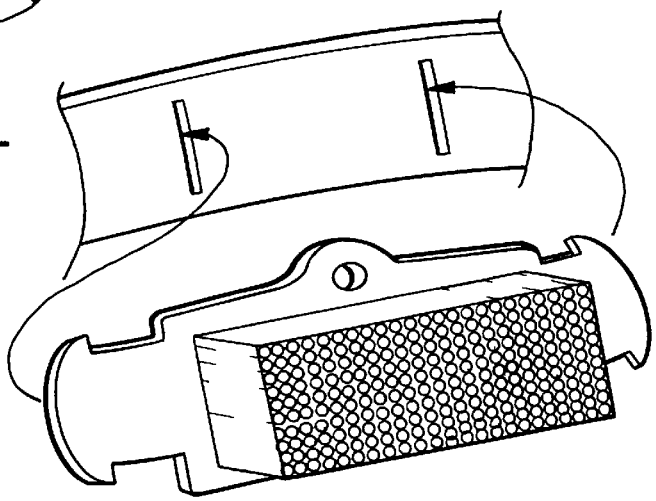
Fig-4
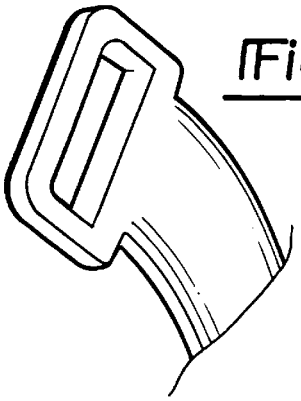
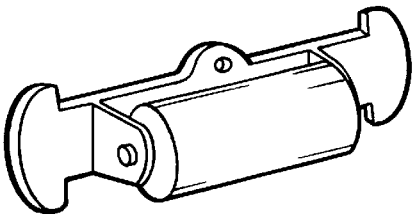
Fig-5
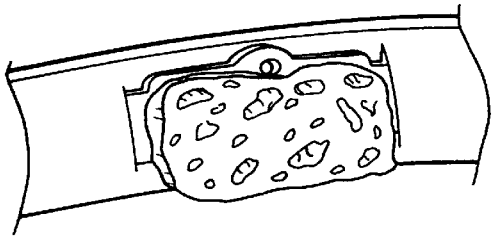
Fig-3

TORSO MASSAGING AND SCRUBBING DEVICE

DEFINITION

The term torso as used herein shall mean the trunk and appendages of a human body or that of any other animal.

FIELD OF THE INVENTION

The present invention relates to a massaging and scrubbing apparatus. More particularly, the invention relates to an apparatus to be used to cleanse or massage the torso of a human or animal.

BACKGROUND OF THE INVENTION

Conventional massaging and scrubbing devices generally include a long handle or an elongated strip of cloth having a brush, scrubbing pad, smooth spherical surface or other similar device attached thereto. While these devices generally permit a user to reach various portions of the user's torso, these devices require a certain amount of physical dexterity to use them. For example, the user may be required to hold the device close to the user's torso, forcing the cloth strip to conform to the shape of the area of the torso being cleansed or massaged, and simultaneously move the massaging or scrubbing device back and forth across the torso. Persons having limited mobility in the arms and shoulders may be incapable of this type of manipulation.

Additionally, cloth covered devices may retain moisture, and thus require more frequent cleaning to help prevent the build-up of mildew or odor causing bacteria on the device.

Consequently, there is a need for a massaging and scrubbing device constructed of a material having a preformed configuration and a resiliency to facilitate use by persons having limited mobility and strength in the arms, hands or shoulders. Additionally, there is a need for a massaging and scrubbing device that is substantially constructed of a water impervious material, which may help to reduce the amount of maintenance necessary to prevent the build-up of mildew or malodorous bacteria on the device due to moisture retention.

SUMMARY OF THE INVENTION

The present invention is directed to a massaging and scrubbing apparatus. The apparatus includes a frame that defines two elongated arms, and a torso contacting device.

The frame may be constructed having a preformed configuration using a water impervious material. The frame has a resiliency thereto that permits the arms to be flexed slightly during use and to spring back to the preformed configuration when not in use. Each arm may support at least one gripping member for supporting the user's hands.

The frame supports the torso contacting device such that each arm extends outwardly from opposing surfaces of the device. The torso contacting device is releasably supported by the frame and can therefore be removed and cleaned or replaced as necessary.

Finally, the apparatus may include a support member for hanging the apparatus when not in use.

BRIEF DESCRIPTION OF THE DRAWINGS

The features and inventive aspects of the present invention will become more apparent upon reading the following detailed description, claims and drawings, of which the following is a brief description:

FIG. 1 shows a perspective view of a massaging and scrubbing apparatus formed in accordance with the teachings of this invention, FIG. 1 showing the apparatus as it would be used by a human user.

FIG. 2 shows a detail view of the apparatus described in FIG. 1 having a torso contacting device positioned thereon, the torso contacting device being shown as a brush.

FIG. 3 shows a detail view of an alternative embodiment of the torso contacting device in the form of a sponge.

FIG. 4 shows a detail view of a gripping member supported by the apparatus described in FIG. 1.

FIG. 5 shows a detail view of another embodiment of the torso contacting device in the form of a roller having a smooth outer surface.

DESCRIPTION OF THE PERFERRED EMBODIMENT

FIG. 1 shows a preferred embodiment of the massaging and scrubbing apparatus 10. Constituent components of the apparatus 10 include a frame 12 and a torso contacting device 14.

The frame 12 includes two elongated, opposing arms 16. As illustrated in FIG. 1, the arms may extend in the same direction, and the space therebetween sized to receive the torso of an average size human being or that of another animal. The frame 12 may be constructed of a water impervious material such as a polyethylene, a corrosion resistant stainless steel or any other material having similar properties. Alternatively, frame 12 may be constructed having two separate elongated arms that support torso contacting device 14 therebetween (described below).

The frame may be constructed in a preformed configuration such as the U-shaped structure shown in FIG. 1. However, one of ordinary skill in the art will appreciate that frame 12 may be constructed using a variety of geometric configurations. Frame 12 has a resiliency that permits it to deform slightly during use and to return to the original configuration when not in use. Frame 12 may be fabricated having a fixed or an adjustable size. For example, frame 12 may be constructed having a maximum distance of 36, 44, or 50 inches between arms 16 to accommodate the trunk of a human torso. However, frame 12 may be constructed of various sizes and shapes to accommodate a variety of differently sized and configured torsos. Finally, frame 12 may support a member 20 from which apparatus 10 may be hung when not in use. Member 20 may be an opening formed in frame 12 as shown in FIGS. 1–3 and 5 or any other similar device such as a latch, hook or any other similar device.

FIG. 1 shows apparatus 10 as it would be positioned around the torso of a human user. To facilitate use, each arm 16 may support a gripping member 18. As shown in FIGS. 1 and 4, gripping member 18 consists of a solid ring defining an open center to accommodate the hand of the user. As shown in FIG. 1, gripping member 18 may be supported by each arm 16 at the distal end thereof. Gripping member 18 also may be alternatively constructed as a simple gripping surface comprising projections and indentations designed to accept the fingers and thumb of a human hand. Gripping member 18 may be integrally formed with frame 12 as shown in FIGS. 1 and 4, or as a separate element capable of being attached to frame 12.

Torso contacting device 14 is supported by frame 12. As shown in FIG. 1, torso contacting device 14 is centrally located on the inner surface of frame 12. Torso contacting device 14 may be releasably supported by frame 12 in a substantially immovable position such that the device 14 remains substantially in position on frame 12 when moved in contact with a surface to be massaged or cleansed as illustrated in FIG. 2. Fastening devices such as snaps, screws, interlocking hooks and loops generally marketed under the trademark VELCRO, or other similar devices may be used to secure torso contacting device 14 to frame 12.

As shown in FIG. 3, torso contacting device 14 may be constructed of a water absorbent, nonabrasive material such as a sponge, terry cloth fabric or other similar material. Additionally, torso contacting device 14 may be a freely rotatable or fixed roller having a smooth external surface as shown in FIG. 5. Alternatively, torso contacting device 14 may be an abrasive material such as a brush that may be rubbed against the torso without causing discomfort as shown in FIG. 2. The form of torso contacting device 14 used will depend on the intended use of apparatus 10. If apparatus 10 is used as a cleaning device, an appropriate cleaning gel, soap or other agent may be applied to the torso contacting device 14.

OPERATION

To use apparatus 10, wet and apply a cleaning agent to torso contacting device 14, if necessary. Next, the user grasps elongated arms 16, draws torso contacting device 14 against the user's torso, and moves frame 12 back and forth such that torso contacting device 14 moves across the area to be cleansed or massaged. Alternatively, the user may grasp elongated arms 16, draw torso contacting device 14 against user's torso, and move the user's torso back and forth against torso contacting device 14.

The embodiment described herein depicts the apparatus as having a U-shaped configuration. However, there are a variety of configurations which may be employed in forming the components described herein. Thus, the disclosed embodiment is given to illustrate the invention. However, it is not meant to limit the scope and spirit of the invention. Therefore, the invention should be limited only by the appended claims.

I claim:

1. A massaging and scrubbing apparatus comprising:

a frame, the frame including a first elongated arm having a preformed arcuate configuration and a second elongated arm also having a preformed arcuate configuration; and a first torso contacting device connected to the frame;

wherein the first and second elongated arms have a resiliency that permits the first and second elongated arms to be flexed slightly during use and to spring back to their respective preformed arcuate configurations;

further, wherein the preformed arcuate configurations are designed for the first and second elongated arms to extend outwardly and forwardly from the first torso contacting device toward areas in front of a user when the first torso contacting device is placed in contact with a torso of a user of the apparatus, further including a second torso contacting device having a different form than the first torso contacting device the frame being releasably connected to the first torso contacting device by at least one fastening device for allowing the first torso contacting device to be removed from the apparatus and replaced by the second torso contacting device, wherein the at least one fastening device includes a D-shaped projection extending from the first torso contacting device that is inserted into a corresponding slot in the frame.

2. The apparatus as defined in claim 1, wherein the first and second elongated arms have a sufficient length and preformed curvature for enabling a person of limited mobility to maintain their arms in front of their trunk while massaging or cleansing.

3. The apparatus as defined in claim 1, wherein the first and second elongated arms each support a gripping member.

4. The apparatus as defined in claim 1, wherein the frame is formed from a water impervious material.

5. The apparatus as defined in claim 1, wherein the torso contacting device includes at least one freely rotatable roller.

6. The apparatus as defined in claim 1, wherein the torso contacting device includes a smooth outer exterior surface.

7. The apparatus as defined in claim 1, wherein the torso contacting device is constructed from a water absorbent material.

8. The apparatus as defined in claim 1, wherein the torso contacting device includes a member from which the apparatus may be hung when not in use.

9. A massaging and scrubbing apparatus comprising:

a frame, the frame including a first elongated ann having a preformed arcuate configuration and a second elongated arm having a preformed arcuate configuration; and a first torso contacting device connected to the frame;

the first and second elongated arms having a resiliency that permits the first and second elongated arms to be flexed slightly during use and to spring back to their respective preformed arcuate configurations;

the preformed arcuate configurations of the first and second elongated arms being selected to permit the first and second elongated arms to extend outwardly and forwardly from the first torso contacting device for positioning a portion of the first and second elongated arms in front of a user of the apparatus when the first torso contacting device is placed in contact with a torso of a user of the apparatus, the first and second elongated arms also having sufficient length and preformed curvature to enable a person of limited mobility to maintain their arms in front of their trunk while massaging or cleansing;

the frame being releasably connected to the first torso contacting device by at least one fastening device for allowing the first torso contacting device to be removed from the apparatus and replaced by a second torso contacting device;

wherein the at least one fastening device includes a D-shaped projection extending from the first torso contacting device for insertion into a corresponding slot in the frame.

* * * * *